United States Patent [19]

Jamison

[11] 4,178,587

[45] Dec. 11, 1979

[54] SECURITY LOCK SYSTEM

[76] Inventor: Fred W. Jamison, 215 E. Palm Ave., Apt. 411, Tampa, Fla. 33602

[21] Appl. No.: 954,657

[22] Filed: Oct. 25, 1978

Related U.S. Application Data

[63] Continuation-in-part of Ser. No. 849,677, Nov. 8, 1977.

[51] Int. Cl.[2] ..... G08B 13/06

[52] U.S. Cl. ..... 340/542; 200/61.67; 200/61.93

[58] Field of Search ..... 340/542, 545; 200/61.67, 61.93, 61.62

[56] References Cited

U.S. PATENT DOCUMENTS

| | | | |
|---|---|---|---|
| 3,197,588 | 7/1965 | Baldwin et al. | 340/542 |
| 3,938,121 | 2/1976 | Jamison | 340/545 |
| 4,024,526 | 5/1977 | Banner | 340/548 |

*Primary Examiner*—Glen R. Swann, III

*Attorney, Agent, or Firm*—Duckworth, Hobby, Allen & Pettis

[57] ABSTRACT

A security lock system of the type primarily intended for signalling unauthorized opening of protected fixtures. The security lock system includes a dead bolt for engaging the fixture to be protected and a switch electrically connected to an alarm system. The dead bolt operatively engages the switch so as to energize the alarm upon an unauthorized removal of the dead bolt from the protected fixture. The alarm system is preferably energized by a direct current, and the security lock system may be utilized to generate both audible and silent type alarms.

9 Claims, 3 Drawing Figures

SECURITY LOCK SYSTEM

The present application is a continuatin-in-part of my prior application SN 849,677, filed Nov. 8, 1977, presently co-pending.

CROSS-REFERENCE TO RELATED DISCLOSURE DOCUMENT

The present application is directed to modifications of the invention disclosed in my Disclosure Document Nos. 050039 and 03135, filed in the U.S. Pat. and Trademark Office.

BACKGROUND OF THE INVENTION

1. Field of the Invention

The present invention relates to a security lock system including a deadbolt/SPDT switch designed for installation on the fixture to be protected, and electrically connected to an alarm device, whereby unauthorized opening of the protected fixture will generate an alarm signal. The security lock system of the present invention is preferably designed for actuation through the use of low voltage direct current and may be utilized to operate both audible and silent alarms. Furthermore, by virtue of the circuit utilized a plurality of fixtures may be monitored by a single installation. 2. Description of the Prior Art It is perhaps a sad comment on the state of our American society, but recent years have witnessed a tremendous increase in both the interest in and availability of residential protection devices in the nature of burglar alarms. Such alarm devices are generally electrically operated, and may be actuated by some mechanical means, by the interruption of a beam of light or some other form of electromagnetic radiation, or even by the interruption by a beam of high frequency sound. Numerous such devices are known in the prior patented art, and my prior U.S. Pat. Nos. 3,466,454; 3,543,268 and 3,938,121 disclose and claim an electrical wiring arrangement designed to integrate an intrusion alarm system with the wiring system for the lighting and various electrically operated appliances in a residence.

Nevertheless, most such prior art devices are of relatively sophisticated construction, requiring both complex installation and maintenance procedures. This has the attendant result of increasing the cost of such current alarm systems, thereby limiting their utilization and the protection afforded thereby to a relatively small segment of the population.

Accordingly, it is clear that there is a great need in the art for a security lock system of simple construction which can be easily installed and maintained in existing residential and commercial structures. It is to this goal that the security lock system of the present invention is directed.

SUMMARY OF THE INVENTION

The present invention is directed to a security lock system of the type primarily intended for signalling unauthorized opening of a protected fixture. The lock system of this invention, in its preferred embodiment, comprises two basic elements: a lock switch means attached to the fixture to be protected, and alarm means electrically connected to the lock switch means to indicate unauthorized opening or tampering with the protected fixture. At this point it should be noted that a plurality of lock switch means may be electrically connected to a single alarm means, thereby providing security at a plurality of discreet locations.

The lock switch means of the present invention comprises a bolt which is mechanically attached to the protected fixture and a single pole double throw (SPDT) switch means, wired NC in the preferred embodiment and maintained in an open position by the bolt. The switch means is electrically connected to the alarm means of the invention, and the alarm means preferably comprises a direct current circuit having a signal means electrically connected thereto.

The direct current circuit means is powered by an internal source of direct current, such as, for example, a dry cell battery, and is normally open. As will be setforth below in greater detail with regard to a preferred embodiment of the present invention, unauthorized manipulation of the bolt will cause the switch to complete the direct current circuit thereby actuating the alarm signal.

The signal means of the present invention may comprise either an audible or silent signal. That is to say, the signal means may comprise an audible siren, or it may simply energize a visual indicator at a remote location such as, for example, a security post.

The signal means of the invention preferably further comprises circuit relay means electrically connected to an auxiliary circuit. Actuation of the security lock system will then not only result in actuation of the first alarm but also will energize the second, or auxiliary circuit. In the preferred embodiment of the invention this auxiliary circuit comprises a standard 110 volt, alternating current, circuit already existing in the protected structure. For example, the auxiliary circuit may control the building's light system, or, for example, an automatic telephone dialer.

By virtue of the relatively simple construction of the lock switch means comprising the bolt means and the switch means of the present invention, the security lock system disclosed herein is imminently suitable for installation in virtually any type structure, including private residences. As is described in greater detail hereinafter, the system is suitable for attachment to both wooden and metal fixtures, including windows and doors. Inasmuch as the system is preferably operated and energized by low voltage direct current, it is quite safe for use in homes including young children.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWING

For fuller understanding of the nature and objects of the invention, reference should be had to the following detailed description taken in connection with the accompanying drawing, in which.

Similar reference character refer to similar parts throughout the several views of the drawings.

DETAILED DESCRIPTION

Figure 1:
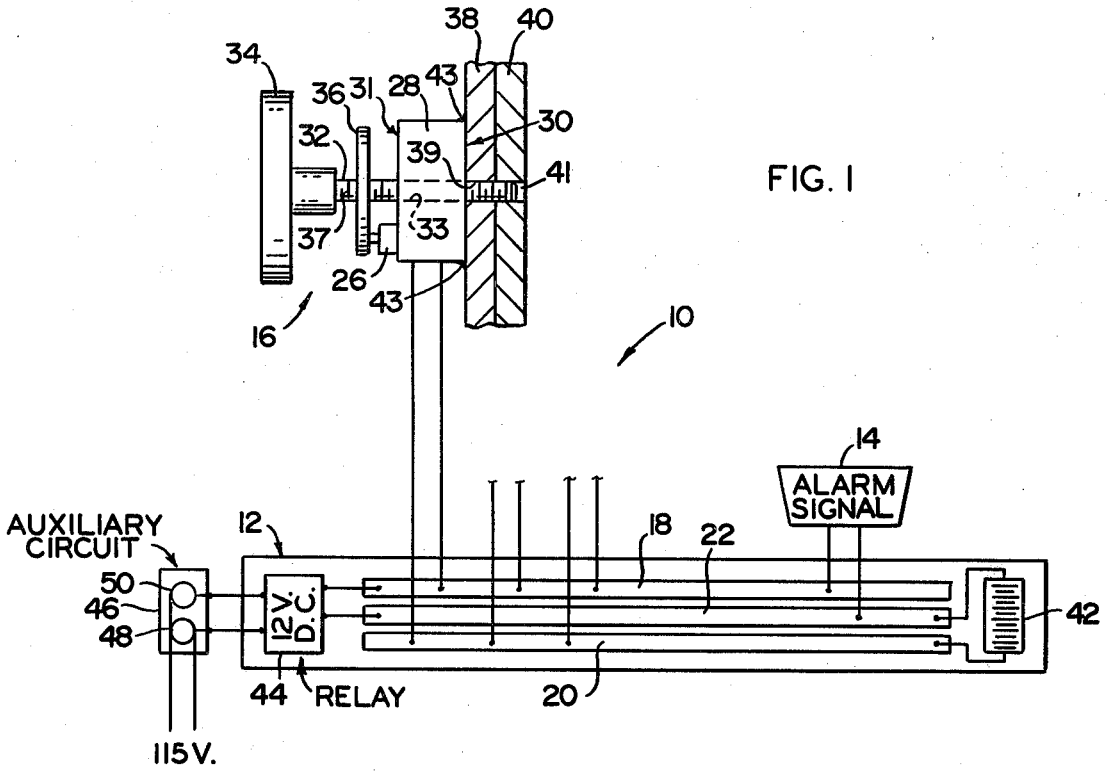
FIG. 1 shows a preferred construction for the security lock system, including the alarm means in schematic representation.

The security lock system of the present invention is generally indicated as 10 in the drawing. As shown therein security lock system 10 comprises an alarm means generally indicated as 12 and lock switch means generally indicated as 16. Attention is first invited to the preferred construction for alarm means 12.

In the preferred embodiment, alarm means 12 includes a signal means comprising first alarm 14. For example, first alarm 14 may comprise an audible siren, or low decibel buzzer, to place under a pillow, inaudible to the intruder. Alarm means 12 further comprises a direct current circuit means including first electrical conduit 18, second electrical conduit 20, and third electrical conduit 22. As will be described in greater detail below, first electrical conduit 18 and second electrical conduit 20 are electrically connected to lock switch means 16, while second electrical conduit 20 and third electrical conduit 22 are electrically connected to a source of direct current such as battery 42.

Alarm means 12 further comprises circuit relay means 44 disposed in electrical interconnecting relationship between first electrical conduit 18 and third electrical conduit 22 and auxiliary circuit means 46. As shown in the view of the drawing, auxiliary circuit means 46 comprises a 115 volt alternating current circuit and the electrical interconnection of circuit relay means 44 thereto is accomplished at electrical connector posts 48 and 50. It is to be understoood that auxiliary circuit means 46 comprises a second alarm, or warning system, in the present invention and may specifically take the form of an existing lighting circuit, and automatic telephone dialer, an audible alarm, a predetermined signal to a remote security post, etc. Obviously, it would be possible to construct and install the security lock system 10 without providing therein circuit relay means 44 and corresponding auxiliary circuit means 46.

Attention is now invited to a preferred construction for lock switch means 16. Lock switch means 16 comprises bolt means 32 removably engagable with the fixture to be protected and switch means generally indicated as 31 mechanically attached to bolt means 32 whereby bolt means 32 may be utilized to open and close switch means 31, resulting in a corresponding opening and closing of the electrical circuit of alarm means 12.

In the illustrated preferred embodiment, switch means 31 comprises on/off state control means 26 and switch body 28. Bolt means 32 is preferably threaded as indicated at 37, and threads 37 operatively engage threaded aperture 33 formed through switch body 28. Knob 34 is provided on one end of bolt means 32 to facilitate its insertion through threaded aperture 33 of switch body 28. A collar 36 is provided on bolt means 32 so as to engage state control means 26 when lock switch means 16 is operatively positioned as shown in the drawing. This mechanical engagement between collar 36 and state control means 26 will, in the preferred embodiment, maintain alarm means 12 in a normally open position.

As shown in the drawing figure, lock switch means 16 is operatively installed on a window installation comprising window sash 38 and window sill 40 as by welding indicated at 43. An aperture 39 is provided at window sash 38, and a corresponding aperture 41 is provided in window sill 40. As illustrated in the drawing of the preferred embodiment, lock switch means 16 is installed by abutting the back of switch body 28 with window sash 38 as indicated at 30 and then tightening bolt means 32 until its free end extends beyond switch body 28 into apertures 39 and 41. Collar 36 is then adjusted into operative contact with state control means 26.

In the position illustrated in the drawing, window sash 38 cannot be moved with respect to window sill 40 without removing bolt means 32. Of course, if bolt means 32 is removed, collar 36 will no longer engage state control means 26, thereby closing open NC switch means 31 and energizing first alarm 14.

Figure 2:
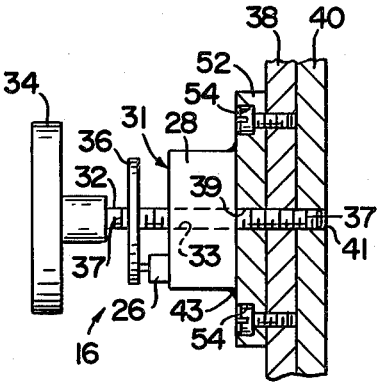
FIG. 2 shows an alternate embodiment for the lock switch means of the security lock system.
Figure 3:
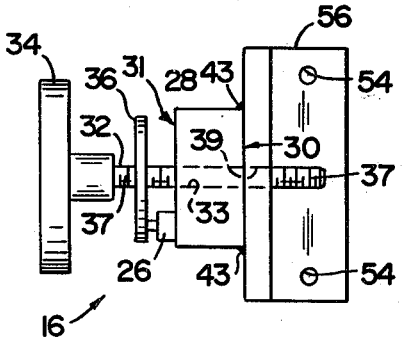
FIG. 3 shows yet another embodiment for the lock switch means.

The views of FIGS. 2 & 3 show alternative means for attaching lock switch means 16 to the fixture to be protected. FIG. 2 illustrates the use of a mounting plate 52 including mounting apertures 54 formed therein. As shown, plate 52 is attached to switch body 28, and standard fastening means such as, for example, non-removable screws may be placed through apertures 54 so as to mechanically attach lock switch means 16 to the fixture to be protected. FIG. 3 is similar to that of FIG. 2 but depicts an L-shaped mounting plate 56.

It is to be noted that the above description has been given with regard to a preferred embodiment for the construction of the present invention. The installation of security lock system 10 on fixtures other than single hung windows such as that illustrated might require minor structural modification. However, the present invention is not to be restricted to window sash installations. Additionally, as indicated by the broken electrical connectors in the drawing, it is conceived that a plurality of lock switch means 16 might be utilized so as to provide security at a variety of fixture locations.

It will thus be seen that the objects setforth above, among those made apparent from the preceeding description, are efficiently attained, and since certain changes might be made in the above construction without departing from the scope of the invention it is intended that all matter contained in the above description or shown in the accompanying drawing shall be interpretted as illustrative and not in a limiting sense.

It is also to be understood tat the following claims are intended to cover all of the generaic and specific features of the invention which, as a matter of language, might be said to fall therebetween.

Now that the inventin has been described,

What is claimed is:

1. A security lock system of the type primarily intended for signalling unauthorized opening of protected fixtures, said security lock system comprising in combination: at least one lock switch means attached to the fixture to be protected; and alarm means electrically connected to said lock switch means whereby unauthorized opening of said lock switch means will actuate said alarm means; said lock switch means comprising bolt means removably engageable with the fixture to be protected and switch means mechanically attached to said bolt means and the fixture to be protected; said bolt means comprising a threaded bolt and a collar formed thereon and said switch means including a threaded aperture formed therethrough and comprising on/off state control means disposed substantially adjacent said aperture in operative relation to said collar, said bolt being movably disposed in said aperture such that at least a portion of said bolt will extend beyond said switch means for engaging the fixture to be protected, and wherein said alarm means comprises direct current circuit means comprising signal means electrically connected to siad switch means, whereby said collar operatively engages said switch means and unauthorized removal of said collar from said switch means will energize said signal means.

2. A security lock system as in claim 1 further comprising a plurality of said lock switch means attached to a corresponding plurality of fixtures to be protected.

3. A security lock system as in claim 2 wherein said alarm means comprises a plurality of direct current circuit means, each one of said circuits being electrically connected to a corresponding one of said lock switch means.

4. A security lock system as in claim 1 wherein said alarm means further comprises a source of direct current and wherein said signal means comprises a first alarm.

5. A security lock system as in claim 4 wherein said signal means further comprises circuit relay means disposed in electrical interconnecting relation with said direct current circuit means, and auxiliary circuit means electrically connected to said circuit relay means, whereby actuation of said first alarm will also energize said auxiliary circuit means.

6. A security lock system as in claim 5 wherein said first alarm comprises an audible siren.

7. A security lock system as in claim 5 wherein said auxiliary circuit means comprises an alternating current circuit.

8. A security lock system as in claim 7 wherein said alternating current circuit comprises a second alarm.

9. A security lock system as in claim 5 wherein first alarm comprises a low decibel buzzer.

* * * * *